US011142383B2

(12) United States Patent
Thompson

(10) Patent No.: US 11,142,383 B2
(45) Date of Patent: Oct. 12, 2021

(54) CARTON WITH HANDLE

(71) Applicant: Graphic Packaging International, LLC, Atlanta, GA (US)

(72) Inventor: Jon Thompson, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 108 days.

(21) Appl. No.: 16/595,858

(22) Filed: Oct. 8, 2019

(65) Prior Publication Data

US 2020/0108988 A1 Apr. 9, 2020

Related U.S. Application Data

(60) Provisional application No. 62/743,221, filed on Oct. 9, 2018.

(51) Int. Cl.

| | |
|---|---|
| ***B65D 71/36*** | (2006.01) |
| ***B31B 50/86*** | (2017.01) |
| ***B31B 50/26*** | (2017.01) |
| ***B31B 50/62*** | (2017.01) |

(Continued)

(52) U.S. Cl.

CPC ..... *B65D 71/36* (2013.01); *B31B 50/26* (2017.08); *B31B 50/86* (2017.08); *B31B 50/624* (2017.08); *B31B 2110/35* (2017.08); *B31B 2120/302* (2017.08); *B65D 2571/0066* (2013.01);

(Continued)

(58) Field of Classification Search

CPC ..... B65D 5/46; B65D 5/462; B65D 71/28; B65D 71/34; B65D 71/36; B65D 2571/00141; B65D 2571/00462; B65D 2571/0066; B65D 2571/00728;

(Continued)

(56) References Cited

U.S. PATENT DOCUMENTS

| | | | |
|---|---|---|---|
| 1,253,193 | A | 1/1918 | Hill |
| 2,681,143 | A | 6/1954 | Guyer |
| 2,810,506 | A | 10/1957 | Kessler |

(Continued)

FOREIGN PATENT DOCUMENTS

| | | |
|---|---|---|
| CA | 1 243 987 | 11/1988 |
| DE | 296 07 374 | 4/1996 |

(Continued)

OTHER PUBLICATIONS

International Search Report and Written Opinion for PCT/US2019/055132 dated Jan. 23, 2020.

*Primary Examiner* — Bryon P Gehman
(74) *Attorney, Agent, or Firm* — Womble Bond Dickinson (US) LLP

(57) ABSTRACT

A carton for containing a plurality of articles is disclosed herein. The carton has a plurality of panels that extends at least partially around an interior of the carton. The plurality of panels comprises at least one top panel and at least one side panel foldably connected to the at least one top panel. The carton includes at least one end flap foldably connected to a respective panel of the plurality of panels and at least partially forming a closed end of the carton. The carton has a handle with at least one handle panel in the at least one top panel and at least one handle relief flap in the closed end of the carton. The at least one handle relief flap is configured to be located between respective adjacent containers of the plurality of containers upon activation of the handle.

30 Claims, 7 Drawing Sheets

(51) Int. Cl.
*B31B 110/35* (2017.01)
*B31B 120/30* (2017.01)

(52) U.S. Cl.
CPC ..... *B65D 2571/00141* (2013.01); *B65D 2571/00462* (2013.01); *B65D 2571/00728* (2013.01)

(58) Field of Classification Search
CPC ..... B31B 50/26; B31B 50/624; B31B 50/86; B31B 2110/35; B31B 2120/302
USPC ..... 206/141, 200, 427, 428
See application file for complete search history.

(56) References Cited

U.S. PATENT DOCUMENTS

| | | | | |
|---|---|---|---|---|
| 2,842,304 | A | | 7/1958 | Ringler |
| 2,868,433 | A | | 1/1959 | Anderson, Jr. |
| 2,955,739 | A | | 10/1960 | Collura |
| 3,076,591 | A | | 2/1963 | Nute et al. |
| 3,112,856 | A | | 12/1963 | MacIntosh et al. |
| 3,300,119 | A | | 1/1967 | Chaussadas |
| 3,904,036 | A | | 9/1975 | Forrer |
| 4,036,423 | A | | 7/1977 | Gordon |
| 4,328,923 | A | | 5/1982 | Graser |
| 4,378,905 | A | | 4/1983 | Roccaforte |
| 4,470,503 | A | | 9/1984 | Stone |
| 4,482,090 | A | | 11/1984 | Milliens |
| 4,498,619 | A | | 2/1985 | Roccaforte |
| 4,546,914 | A | | 10/1985 | Roccaforte |
| 4,588,084 | A | | 5/1986 | Holley, Jr. |
| 4,747,534 | A | | 5/1988 | Marie |
| 5,020,337 | A | | 6/1991 | Krieg |
| 5,197,598 | A | | 3/1993 | Stout et al. |
| 5,240,174 | A | | 8/1993 | Wenninger |
| 5,292,058 | A | | 3/1994 | Zoss et al. |
| 5,297,725 | A | | 3/1994 | Sutherland |
| 5,328,081 | A | | 7/1994 | Saulas |
| 5,333,734 | A | | 8/1994 | Stout et al. |
| 5,385,234 | A | | 1/1995 | Stout et al. |
| 5,395,044 | A | | 3/1995 | Stout |
| 5,482,203 | A | | 1/1996 | Stout |
| 5,495,727 | A | | 3/1996 | Strong et al. |
| 5,582,343 | A | | 12/1996 | Dalvey |
| 5,639,017 | A | | 6/1997 | Fogle |
| 5,738,273 | A | | 4/1998 | Auclair |
| 5,794,778 | A | | 8/1998 | Harris |
| 5,796,778 | A | | 8/1998 | Kurker |
| 5,873,515 | A | | 2/1999 | Dunn et al. |
| 5,878,946 | A | | 3/1999 | Frerot et al. |
| 5,915,546 | A | | 6/1999 | Harrelson |
| 5,992,733 | A | | 11/1999 | Gomes |
| 6,019,276 | A | | 2/2000 | Auclair |
| 6,065,590 | A | | 5/2000 | Spivey |
| 6,112,977 | A | * | 9/2000 | Sutherland ..... B65D 71/36 206/427 |
| 6,131,803 | A | | 10/2000 | Oliff et al. |
| 6,164,526 | A | | 12/2000 | Dalvey |
| 6,260,755 | B1 | | 7/2001 | Bates et al. |
| 6,631,803 | B2 | | 10/2003 | Rhodes et al. |
| 6,899,221 | B2 | | 5/2005 | Skolik et al. |
| 6,905,066 | B2 | | 6/2005 | Holley et al. |
| 6,926,193 | B2 | | 8/2005 | Smalley |
| 7,748,603 | B2 | | 7/2010 | Fogle et al. |
| 8,191,761 | B2 | | 6/2012 | Brand |
| 8,740,051 | B2 | | 6/2014 | Gonzalez |
| 9,656,789 | B2 | | 5/2017 | Requena |
| 10,421,578 | B2 | | 9/2019 | Holley, Jr. |
| 2001/0017314 | A1 | | 8/2001 | Boukredine et al. |
| 2003/0006158 | A1 | | 1/2003 | Skolik et al. |
| 2003/0015579 | A1 | | 1/2003 | LeBras et al. |
| 2005/0247767 | A1 | | 11/2005 | Smalley |
| 2006/0273143 | A1 | | 12/2006 | Finch |
| 2007/0051781 | A1 | | 3/2007 | Holley, Jr. |
| 2007/0095882 | A1 | | 5/2007 | Holley, Jr. |
| 2007/0164091 | A1 | | 7/2007 | Fogle et al. |
| 2007/0181658 | A1 | | 8/2007 | Sutherland |
| 2007/0272184 | A1 | | 11/2007 | Rommel |
| 2008/0048014 | A1 | | 2/2008 | Bates |
| 2008/0099544 | A1 | | 5/2008 | Skolik |
| 2009/0014508 | A1 | | 1/2009 | Marie |
| 2012/0012600 | A1 | | 1/2012 | Gonzalez |
| 2012/0211552 | A1 | | 8/2012 | Kastanek et al. |
| 2014/0238882 | A1 | | 8/2014 | Requena |

FOREIGN PATENT DOCUMENTS

| | | |
|---|---|---|
| DE | 20 2004 018 649 | 4/2005 |
| EP | 0 754 631 | 1/1997 |
| FR | 2 481 231 | 10/1981 |
| GB | 2 206 565 | 1/1989 |
| GB | 2 422 819 | 8/2006 |
| WO | WO 95/05324 | 2/1995 |
| WO | WO 96/01770 | 1/1996 |
| WO | WO 96/20881 | 7/1996 |
| WO | WO 96/21603 | 7/1996 |
| WO | WO 96/27538 | 9/1996 |
| WO | WO 96/35624 | 11/1996 |
| WO | WO 97/44253 | 11/1997 |
| WO | WO 99/28207 | 6/1999 |
| WO | WO 00/20288 | 4/2000 |
| WO | WO 02/36440 | 5/2002 |
| WO | WO 2006/084009 | 8/2006 |
| WO | WO 2007/089282 | 8/2007 |
| WO | WO 2010/014862 | 2/2010 |

* cited by examiner

CARTON WITH HANDLE

CROSS-REFERENCED TO RELATED APPLICATIONS

This application claims the benefit of U.S. Provisional Application No. 62/743,221, filed Oct. 9, 2018.

INCORPORATION BY REFERENCE

The entire contents of U.S. Provisional Application No. 62/743,221, filed Oct. 9, 2018, are hereby incorporated by reference as if presented herein in its entirety.

BACKGROUND OF THE DISCLOSURE

The present disclosure generally relates to cartons for holding containers. More specifically, the present disclosure relates to a carton having a handle.

SUMMARY OF THE DISCLOSURE

In one aspect, the present disclosure is generally directed to a carton for containing a plurality of articles. The carton includes a plurality of panels that extends at least partially around an interior of the carton. The plurality of panels has at least one top panel and at least one side panel foldably connected to the at least one top panel. The carton has at least one end flap respectively foldably connected to a respective panel of the plurality of panels. The at least one end flap at least partially forms a closed end of the carton. The carton has a handle including at least one handle panel in the at least one top panel and at least one handle relief flap in the closed end of the carton. The at least one handle relief flap is for being located between respective adjacent containers of the plurality of containers upon activation of the handle.

In another aspect, the disclosure is generally directed to a blank for forming a carton for containing a plurality of articles. The blank includes a plurality of panels including at least one top panel and at least one side panel foldably connected to the at least one top panel. The blank has at least one end flap respectively foldably connected to a respective panel of the plurality of panels. The at least one end flap at least partially forms a closed end of a carton formed from the blank. The blank has handle features for forming a handle in the carton formed from the blank. The handle features include at least one handle panel in the at least one top panel and at least one handle relief flap in the closed end of the carton formed from the blank. The at least one handle relief flap is for being located between respective adjacent containers of the plurality of containers upon activation of the handle.

In another aspect, the disclosure is generally directed to a method of forming a carton for containing a plurality of containers. The method includes obtaining a blank that includes a plurality of panels having at least one top panel, at least one side panel foldably connected to the at least one top panel. The blank has at least one end flap respectively foldably connected to a respective panel of the plurality of panels and handle features comprising at least one handle panel in the at least one top panel and at least one handle relief flap in the at least one end flap. The method includes forming an interior of the carton by positioning the plurality of panels and forming an at least partially closed end of the carton by positioning the at least one end flap. The method further includes forming a handle of the carton by positioning the handle features by positioning the at least one handle relief flap to be located between respective adjacent containers of the plurality of containers upon activation of the handle.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum beverage cans) as disposed within the carton embodiments. In this specification, the terms "lower," "bottom," "upper" and "top" indicate orientations determined in relation to fully erected and upright cartons.

Figure 1:
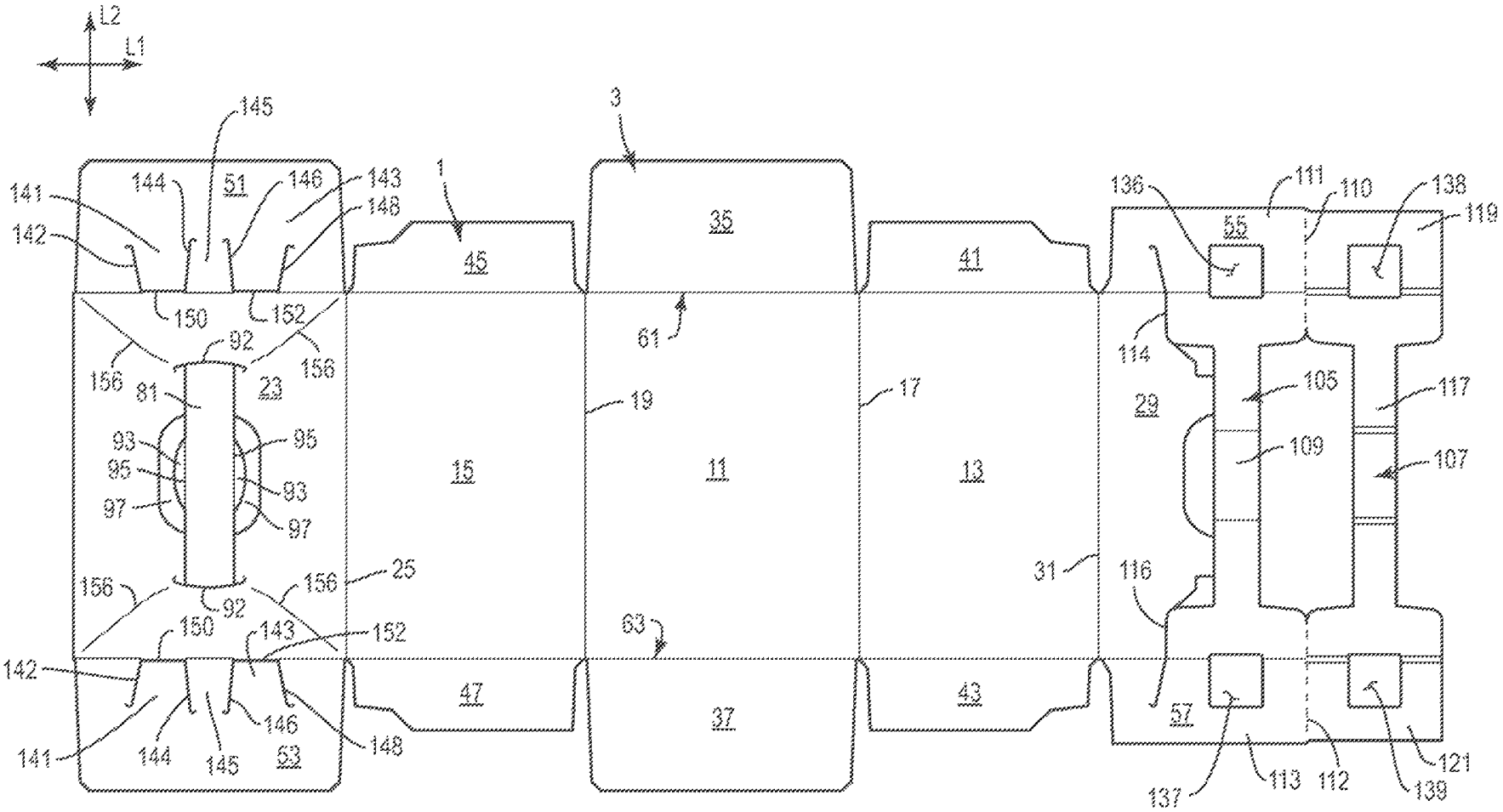
FIG. 1 is a plan view of an exterior surface of a blank for forming a carton according an embodiment of the disclosure.
Figure 4:
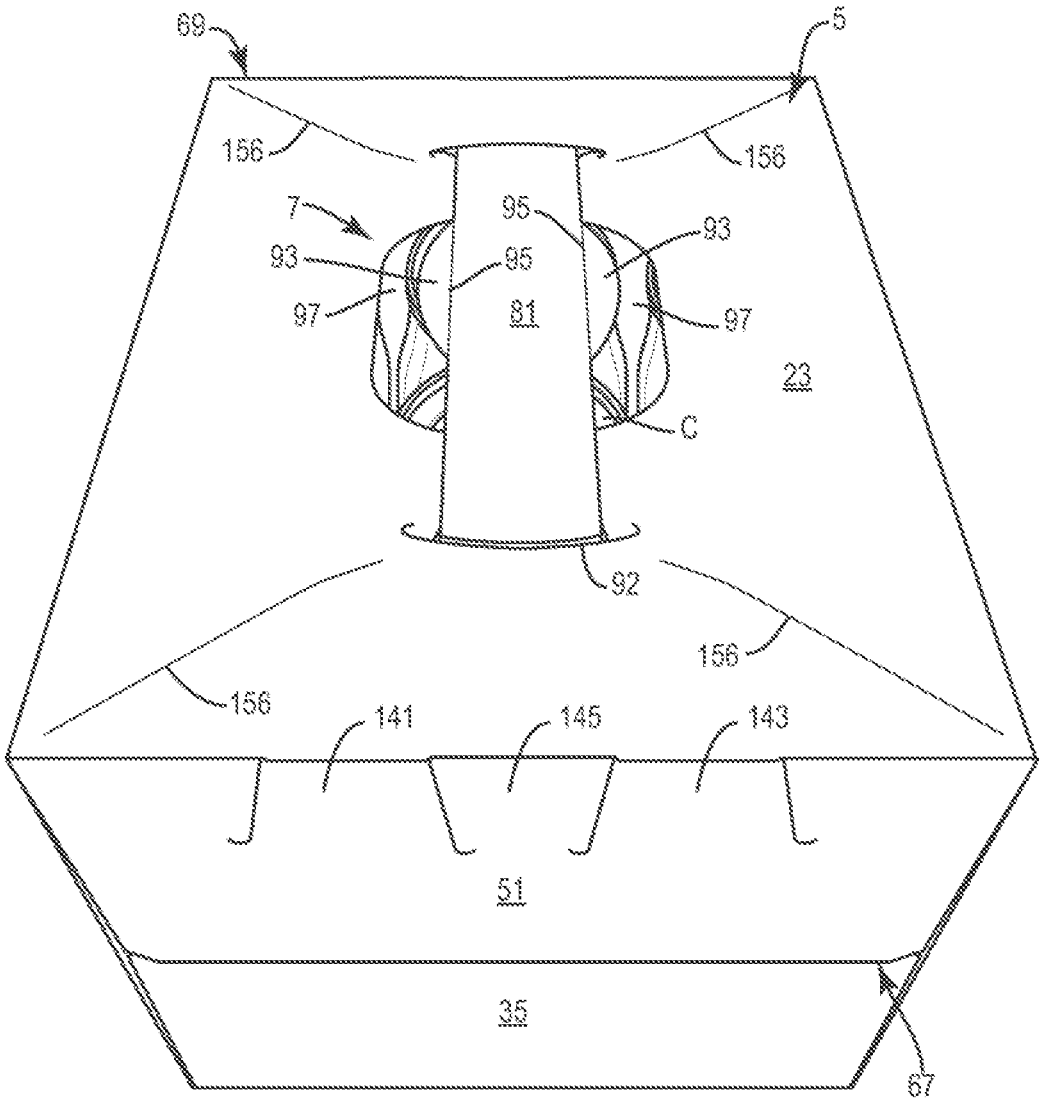
FIGS. 4-5 are perspective views of the assembled carton before handle activation, according an embodiment of the disclosure.
Figure 5:
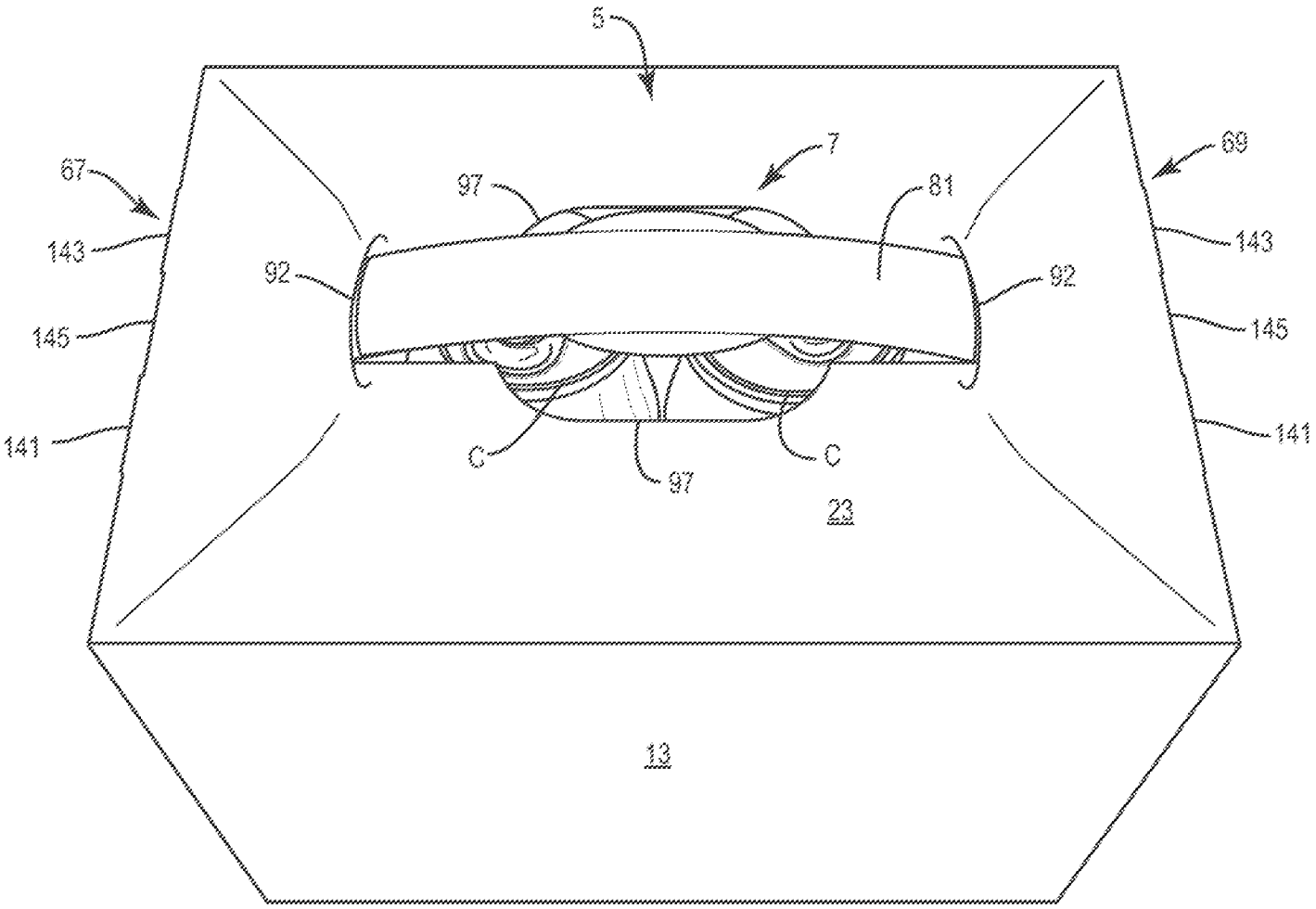
Figure 6:
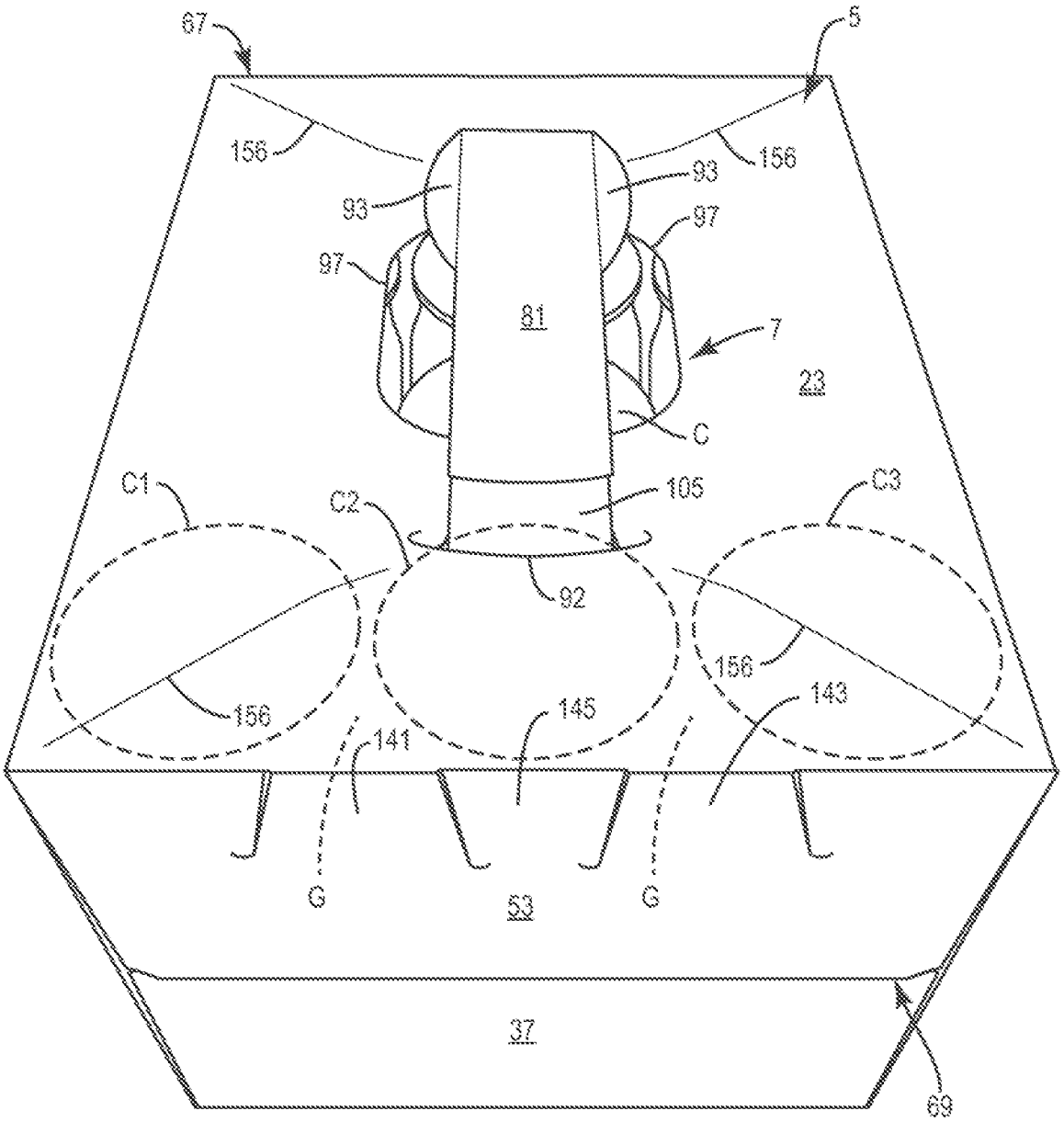
FIGS. 6-7 are perspective views of the assembled carton with an activated handle, according an embodiment of the disclosure.

FIG. 1 is a plan view of the exterior side 1 of a blank, generally indicated at 3, used to form a carton 5 (FIGS. 4-6) according to the exemplary embodiment of the disclosure. The carton 5 can be used to house a plurality of articles such as containers C (FIGS. 4-6). The carton 5 has a handle, generally indicated at 7 (FIGS. 4-7), for grasping and carrying the carton. In the illustrated embodiment, the carton 5 is sized to house twelve containers C in a single layer in a 3×4 arrangement, but it is understood that the carton may be sized and shaped to hold containers of a different or same quantity in more than one layer and/or in different row/column arrangements (e.g., 3×3, 3×5, 3×6, 1×6, 2×6, 4×6, 2×9, 2×6×2, 3×4×2, 2×3×2, 3×5×2, 3×6×2, etc.). In the illustrated embodiment, the containers C are cans, but other types of containers can be used in the carton 5 without departing from the disclosure.

Figure 2:
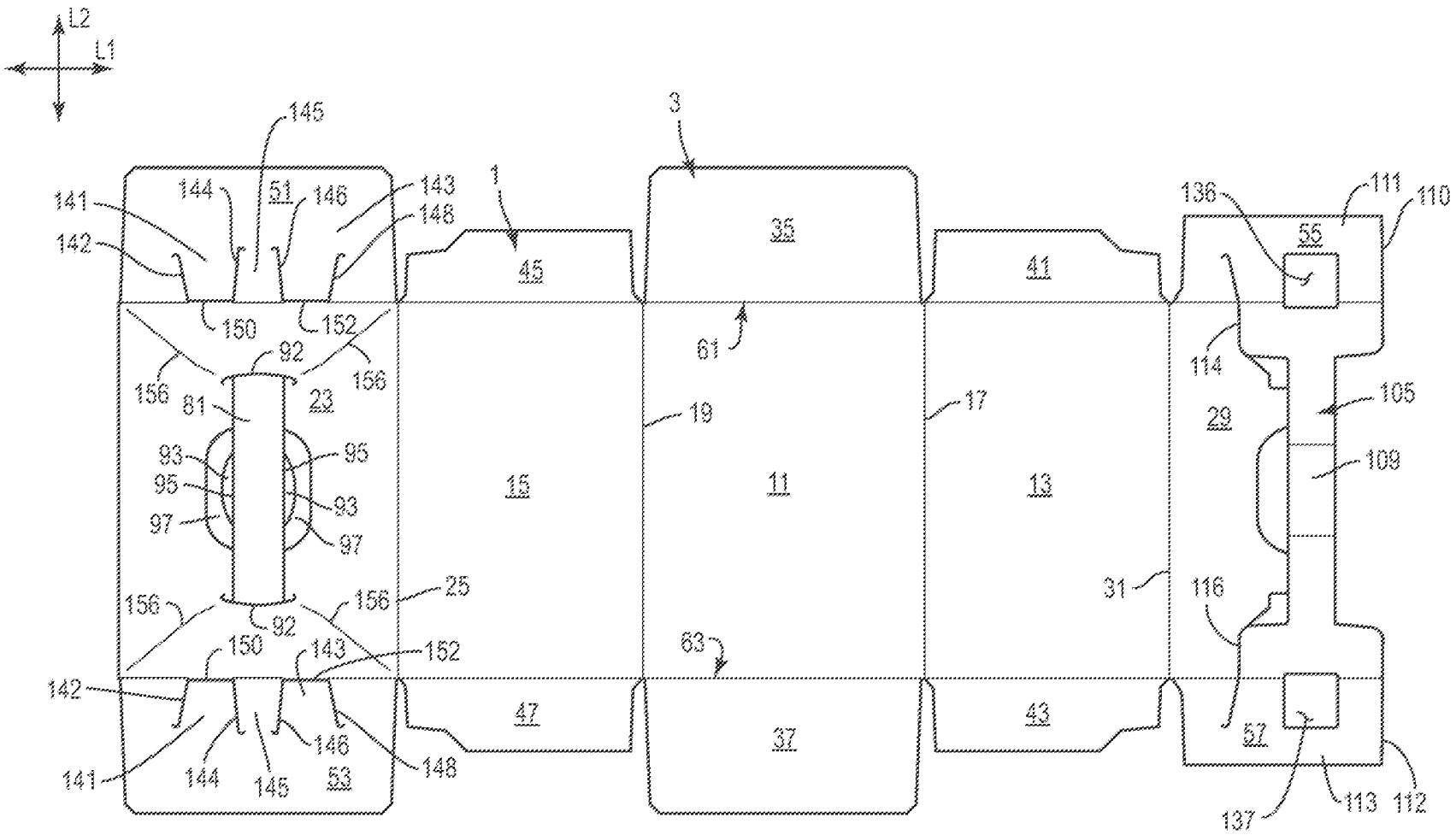
FIG. 2 is a plan view of the exterior surface of the blank for forming the carton with an optional handle panel folded therein, according an embodiment of the disclosure.

The blank 3 has a longitudinal axis L1 and a lateral axis L2 (FIGS. 1-2). The blank 3 comprises a bottom panel 11 foldably connected to a first side panel 13 at a lateral fold line 17, a second side panel 15 foldably connected to the bottom panel at a lateral fold line 19, a first top panel 23 foldably connected to the second side panel 15 at a lateral fold line 25, and a second top panel 29 foldably connected to the first side panel 13 at a lateral fold line 31. The first and second top panels 23, 29 will at least partially overlap in the erected carton 5.

The bottom panel 11 is foldably connected to bottom end flaps 35 and 37. The first side panel 13 is foldably connected to side end flaps 41 and 43. The second side panel 15 is foldably connected to side end flaps 45 and 47. The first top panel 23 is foldably connected to top end flaps 51 and 53. The second top panel 29 is foldably connected to top end flaps 55 and 57.

The end flaps 35, 41, 45, 51, 55 extend along a first marginal area of the blank 3, and are foldably connected at a first longitudinal fold line 61 that extends along the length of the blank. The end flaps 37, 43, 47, 53, 57 extend along a second marginal area of the blank 3, and are foldably connected at a second longitudinal fold line 63 that also extends along the length of the blank. The longitudinal fold lines 61, 63 may be, for example, substantially straight, or oblique at one or more locations to account for blank thickness or for other factors. When the carton 5 is erected, the end flaps 35, 41, 45, 51, 55 close a first end 67 of the carton, and the end flaps 37, 43, 47, 53, 57 close a second end 69 of the carton. In accordance with an alternative embodiment of the present disclosure, different flap arrangements can be used for closing the ends 67, 69 of the carton 5, or one or both of the ends 67, 69 could be partially closed by the end flaps, or closed in an alternative manner without departing from the disclosure.

The blank 3 has handle features that form the handle 7 in the carton 5. The handle features include a first handle panel 81 in the first top panel 23 and two handle flaps 93 foldably connected to the handle panel at respective lateral fold lines 95. The first top panel includes two arcuate openings 97, each opening being adjacent a respective handle flap 93. Two curved cuts 92 are at respective ends of the first handle panel 81. The first handle panel 81 may be used for grasping and carrying the carton 5.

The handle features also include a second handle panel 105 in the second top panel 29 and a reinforcement panel (broadly "third handle panel") 107 foldably attached to the second top panel 29 at two lines of weakening 110, 112. In one embodiment, the second handle panel 105 and the third handle panel 107 may cooperate with the first handle panel 81 to form the handle 7. The second handle panel 105 has a central portion or gripping portion 109 in the second top panel 29 and end portions 111, 113 that are wider than the central portion 109. The second handle panel 105 includes a portion of the top panel 29 and respective end flaps 55, 57. The end portions 111, 113 are separable from the second top panel 29 by respective cuts 114, 116.

In the illustrated embodiment, the second handle panel 105 has respective openings 136, 137 in respective end portions 111, 113. The second handle panel 105 could be otherwise shaped, arranged, configured, and/or omitted without departing from the disclosure. Similar to the second handle panel 105, the third handle panel 107 has a central portion or gripping portion 117 and end portions 119, 121 that are wider than the central portion 117. The third handle panel 107 has respective openings 138, 139 in respective end portions 119, 121. The third handle panel 107 could be otherwise shaped, arranged, configured, and/or omitted without departing from the disclosure.

In the illustrated embodiment, the handle features further include a first handle relief flaps 141 and a second handle relief flap 143 in each top end flap 51, 53. The first handle relief flap 141 is located in each closed end 67 and 69 and is formed by lines of weakening that includes a first cut 142 and a second cut 144 extending from the respective fold lines 61 and 63. Similarly, the second handle relief flap 143 is located in each closed end 67 and 69 and is formed by lines of weakening that includes a first cut 146 and a second cut 148 extending from the respective fold lines 61 and 63. The first and second handle relief flaps 141, 143 also respectively include third cuts 150 and 152 that are longitudinal cuts generally collinear with the respective fold lines 61 and 63. In the embodiment illustrated in FIGS. 1-7, the cuts 142, 144, 146, and 148 are oblique cuts. In other embodiments, the cuts 141, 144, 146, and 148 are straight cuts or they may be shaped otherwise. One or both of the handle relief flaps 141, 143 could be alternatively shaped, arranged, configured, and/or omitted without departing from the disclosure.

The handle features include a respective central handle flap 145 in a respective one of the end flaps 51, 53. Each central handle flap 145 is adjacent to the respective first and second handle relief flap 141, 143. As indicated in FIGS. 1-2, the central handle flap 145 is generally aligned in the longitudinal direction L1 with the first handle panel 81. In the embodiment illustrated in FIGS. 1-7, the central handle flap 145 is in between the respective first and second handle relief flaps 141, 143. In other embodiments, the central handle flap 145 may be alternatively shaped, arranged, configured, positioned, and/or omitted without departing from the disclosure.

When the carton 5 is formed from the blank, respective portions of the end portions 111, 113, 119, 121 of the second handle panel 105 and the third handle panel 107 that are adjacent the openings 136, 137, 138, 139 are aligned and in face-to-face contact with the respective handle relief flaps 141, 143 when the second handle panel 105 and the third handle panel 107 cooperate with the first handle panel to form the handle 7. In some embodiments, the portions of the end portions 111, 113, 119, 121 adjacent the openings 136, 137, 138, 139 can be adhered to a respective handle relief flap 141, 143. The overlapped openings 136, 137, 138, 139 in the end portions 111, 113, 119, 121 are aligned with the central handle flap 145 in each of the top end flaps 51, 53 such that the handle 7 can flex around the central middle container C and allow the handle 7 to raise and flex upwardly when the carton 5 is lifted.

Thus, when the first and second handle relief flaps 141, 143 flex inwards, the central handle flap 145, being aligned with the container adjacent the closed ends 67, 69, remains continuous with the closed ends 67, 69 and remains aligned with the respective opening 136, 137, 138, and 139. This further ensures that the containers C remain in position when the carton 5 is lifted via the handle 7. For example, referring to FIGS. 6-7, the central handle flap 145 remains continuous with the end 69, and in substantially the same or similar location with respect to the containers C before and after activation of the handle 7, wherein the first and second handle flaps 141, 143 flex inwardly when the handle 7 is activated.

The first top panel 23 further includes oblique fold lines 156 extending from respective ends of the first handle panel and extending toward a respective corner of the first top panel. The oblique fold lines 156 allow the handle 7 to raise and flex upwards when the carton 5 is lifted. The features that are for forming the handle 7 could be otherwise shaped, arranged, and positioned without departing from the disclosure.

Figure 3:
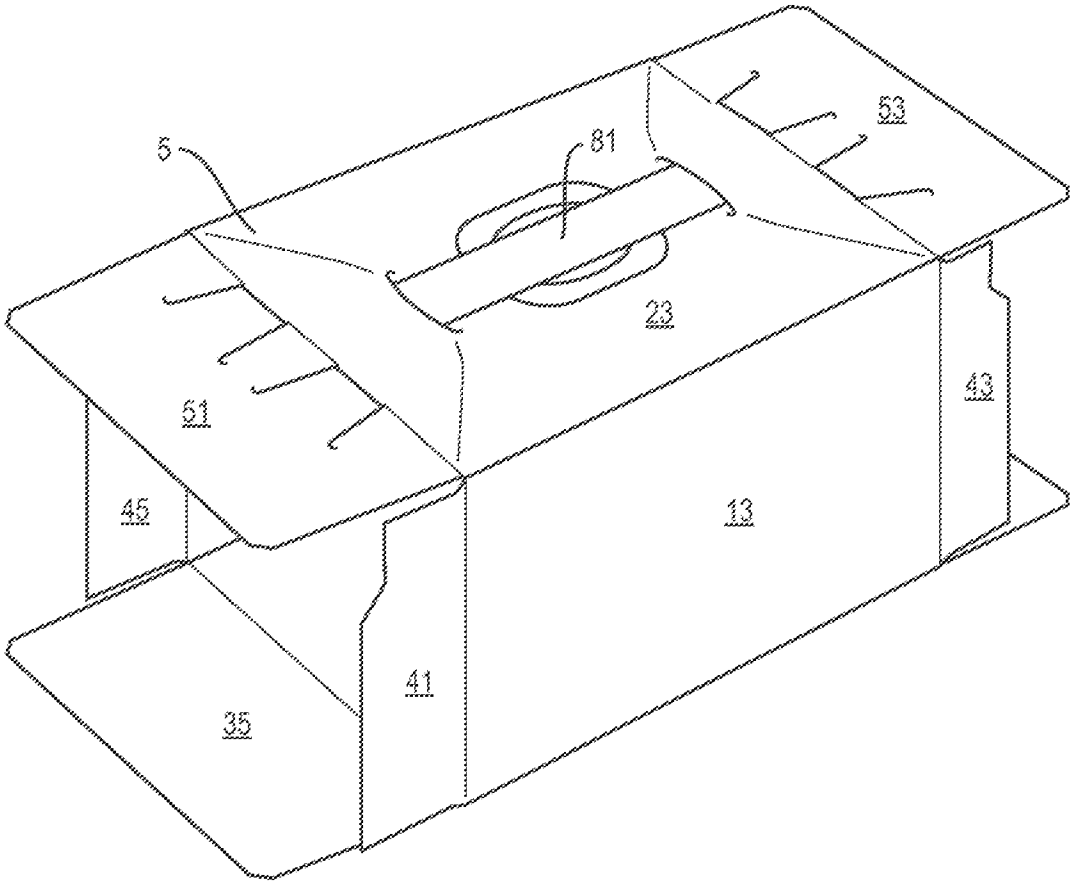
FIG. 3 is a perspective view of a partially assembled carton with an open ended sleeve, according an embodiment of the disclosure.

An exemplary method of erecting the carton 5 is discussed in detail below. At various stages of the erecting process, glue or other adhesive can be applied over various portions of the blank 3. As shown in FIGS. 1-3, the blank 3 is first positioned with the exterior surface 1 facing up. The handle 7 is formed by folding the handle reinforcement panel 107 about lines of weakening 110, 112 so that the second handle panel 105 overlaps and is in face-to-face contact with the third handle panel 107 (FIG. 2). Glue can be applied to portions of either the second or third handle panel 105, 107 to adhesively secure the second and third handle panels. Respective portions of the end portions 119, 121 of the third handle panel 107 that are adjacent openings 138, 139 are aligned and in face-to-face contact with respective portions of the end portions 111, 113 of the second handle panel 105 that are adjacent openings 136, 137. In an embodiment, respective openings 136, 137 overlap respectively with openings 138, 139 when the third handle panel 107 is folded relative to the second handle panel 105. As shown in FIG. 3, the blank 3 is further folded to form the handle 7 by folding at the lateral fold lines 17, 19, 25, 31 and positioning the first top panel 23 to overlap the second top panel 29 and overlapping the second and third handle panels 105, 107. In one embodiment, the first handle panel 81 is adhesively secured to the second handle panel 105. As such, the handle 7 has three layers of material (first handle panel 81, second handle panel 105, and third handle panel 107).

The partially assembled blank of FIG. 2 can be assembled into an open-ended sleeve S (FIG. 3) so that containers C can be loaded into the sleeve. After loading the containers B, the ends 67, 69 of the carton can be closed by at least partially overlapping and adhering the end flaps 35, 41, 45, 51, 55 at one end 67 of the carton and at least partially overlapping and adhering the end flaps 37, 43, 47, 53, 57 at the other end 69 of the carton. The overlapped top end flaps at each end (e.g., 53, 57 at end 69) are downwardly folded and secured to the bottom end flap (e.g., 37) and side end flaps 43, 47 at the same end. The ends 67, 69 of the carton 5 could be closed by other closing steps and features without departing from the disclosure. When the containers C are loaded into the carton, the first and second handle relief flaps 141, 143 are generally aligned with gaps G or spaces between adjacent containers C in each closed end 67, 69, as indicated in FIG. 6 where dashed circles C1, C2, and C3 indicate tops of the containers C inside the carton 5. Similarly, the central handle flap 145 is generally aligned with a container C adjacent to each closed end 67, 69, such as the container indicated by the dashed circle C2 in FIG. 6. In an embodiment, the central handle flap 145 is in direct contact with the container represented by the dashed circle C2. In other embodiments, the central handle flap 145 is in close proximity with the container represented by the dashed circle C2. FIGS. 4-5 show the formed carton 5 before activation of the handle 7.

Figure 7:
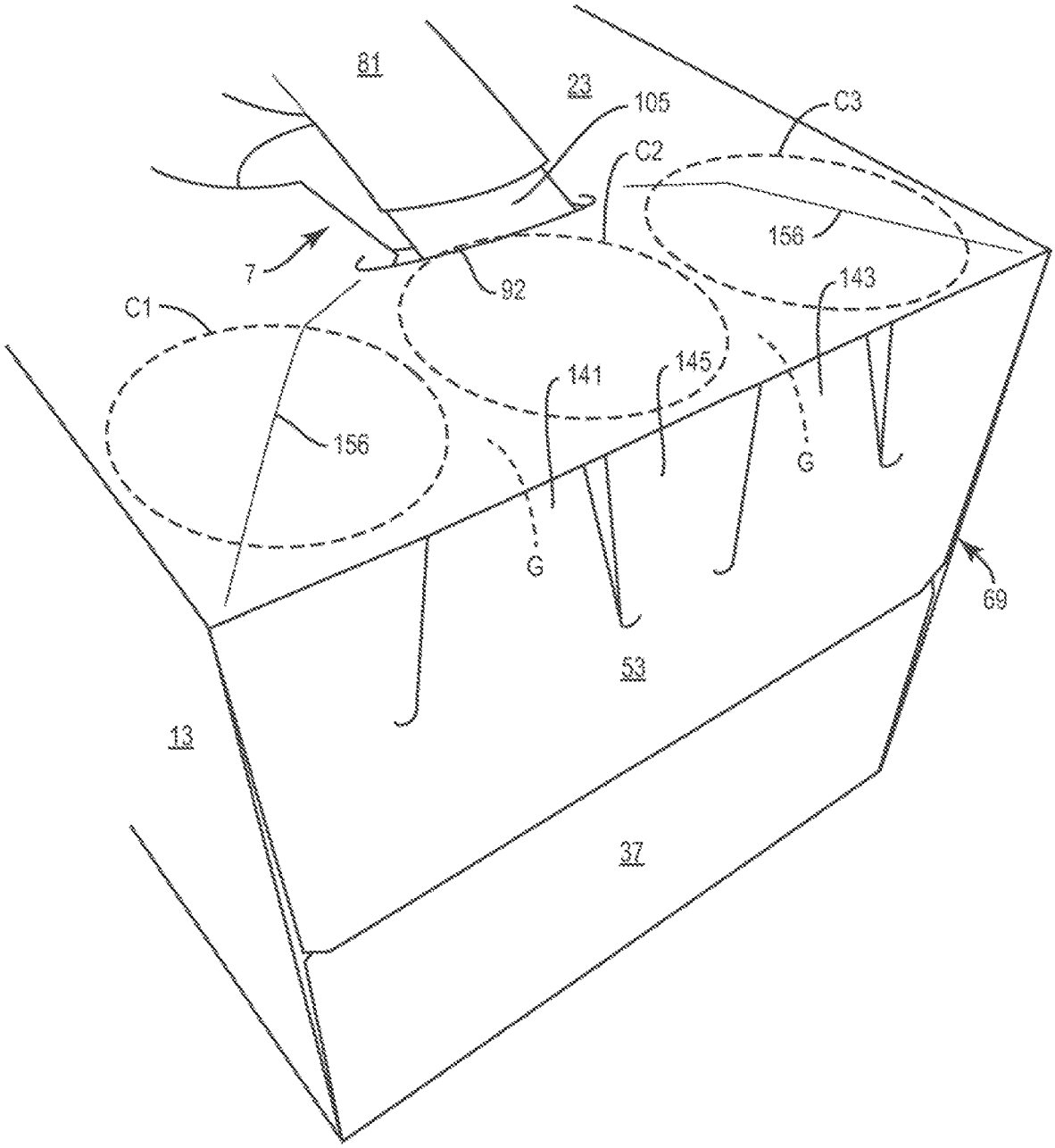

As shown in FIGS. 4-7, the handle 7 is activated by grasping and lifting the overlapped handle panels 81, 105, 107 upwardly as shown in FIGS. 6-7. By upwardly lifting the overlapped handle panels 81, 105, 107 the two handle relief flaps 141, 143 at each end 67, 69 flex inward toward the interior of the carton 5 in the gaps G or spaces between adjacent containers C (indicated by dashed circles in FIGS. 6-7). Respective portions of the end portions 111, 113, 119, 121 of the second handle panel 105 and the third handle panel 107 that are adjacent the openings 136, 137, 138, 139 are aligned and in face-to-face contact with the respective handle relief flaps 141, 143. In some embodiments the portions of the end portions 111, 113, 119, 121 adjacent the openings 136, 137, 138, 139 can be adhered to a respective handle relief flap 141, 143. The overlapped openings 136, 137, 138, 139 in the end portions 111, 113, 119, 121 are aligned with the central handle flap 145 in each of the top end flaps 51, 53 such that the handle 7 can flex around the central middle container C and allow the handle 7 to raise and flex upwardly when the carton 5 is lifted. When the handle is activated, the central handle flap 145 is aligned with a container C adjacent to the closed end (FIGS. 6-7) and remains continuous with the closed ends of the carton. The central handle flap 145 remaining continuous with the closed ends 67, 69 and aligned with a container C adjacent the closed ends 67, 69 in cooperation with the handle relief flaps 141, 143 flexing inwardly in the space between the containers C. The position of the central handle flap 145 strengthens the handle 7 and prevents tearing or other weakening of the carton 5 upon activation of the handle 7 and lifting the carton 5.

In the illustrated embodiment, the handle 7 is formed from the handle features of the blank comprises three layers of material (first handle panel 81, second handle panel 105, and third handle panel 107) in the top of the carton 5, and three layers of material in the ends 67, 69 of the carton. The configuration of the end portions 111, 113, 119, 121 and the handle relief flaps 141, 143 and central handle flap 145 allows the features of the handle 7 to fit between adjacent containers C so that the carton 5 can be used with cylindrical containers or cans oriented having a top end adjacent the top panels 23, 29 of the carton and a bottom end adjacent the bottom panel 11 of the carton. The features of the handle 7 could be used with cartons having cans that have other orientations or the handle could be used with cartons housing containers that are other than cans without departing from the disclosure. The handle 7 could have other features and could include additional reinforcing layers or portions without departing from the disclosure.

In general, the blanks described herein may be constructed from paperboard having a caliper so that it is heavier and more rigid than ordinary paper. The blanks can also be constructed of other materials, such as cardboard, sheet plastics or any other material having properties suitable for enabling the cartons to function at least generally as described above. The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place, and is not intended to exclude heat, chemical, or frequency bonding techniques.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extends at least partially around an interior of the carton, the plurality of panels comprising at least one top panel and at least one side panel foldably connected to the at least one top panel;

at least one end flap respectively foldably connected to a respective panel of the plurality of panels, the at least one end flap at least partially forming a closed end of the carton, wherein the at least one end flap comprises a top end flap foldably connected to the at least one top panel; and a handle comprising at least one handle panel in the at least one top panel, a central handle flap in the top end flap, and at least one handle relief flap in the closed end of the carton, wherein the central handle flap is adjacent the at least one handle relief flap in the closed end, the at least one handle relief flap is defined by at least one line of weakening in the top end flap, the handle is for being activated by lifting at least the at least one handle panel, and the at least one handle relief flap is for being located between respective adjacent containers of the plurality of containers upon activation of the handle;

wherein the at least one handle panel comprises a first handle panel in the at least one top panel for grasping and carrying the carton, the first handle panel is generally aligned with the central handle flap, the central handle flap is generally aligned with a container adjacent the closed end of the carton so that the central handle flap remains continuous with the closed end of the carton upon activation of the handle.

2. The carton of claim 1, wherein the at least one top panel comprises a first top panel and a second top panel, and the at least one side panel comprises a first side panel and a second side panel, the first top panel is foldably connected to the second side panel and the second top panel is foldably connected to the first side panel, the at least one handle panel further comprises a second handle panel formed in the second top panel, the second handle panel comprises a central portion and an end portion that is wider than the central portion.

3. The carton of claim 2, wherein the top end flap is a first top end flap foldably connected to the first top panel, and the at least one end flap comprises a second top end flap foldably connected to the second top panel, the end portion is at least partially defined by a line of weakening that extends into the second top end flap.

4. The carton of claim 3, wherein the end portion comprises an opening in at least a portion of the second top end flap.

5. The carton of claim 4, wherein the first handle panel and the second handle panel are in at least partial face-to-face contact, the opening is aligned with the central handle flap, the at least one handle relief flap comprises a first handle relief flap and a second handle relief flap in the top end flap, and the end portion at least partially overlaps the first handle relief flap and the second handle relief flap.

6. The carton of claim 2, wherein the at least one handle panel further comprises a third handle panel foldably connected to the second handle panel.

7. The carton of claim 6, wherein the second handle panel and the third handle panel cooperate with the first handle panel to form the handle.

8. The carton of claim 2, wherein the handle further comprises at least one handle flap foldably connected to the first handle panel at a respective lateral fold line and the first top panel comprises at least one arcuate opening respectively adjacent to the at least one handle flap.

9. A carton for containing a plurality of articles, the carton comprising:

a plurality of panels that extends at least partially around an interior of the carton, the plurality of panels comprising at least one top panel and at least one side panel foldably connected to the at least one top panel;

at least one end flap respectively foldably connected to a respective panel of the plurality of panels, the at least one end flap at least partially forming a closed end of the carton, wherein the at least one end flap comprises a top end flap foldably connected to the at least one top panel, and the top end flap is foldably connected to the at least one top panel at a fold line; and a handle comprising at least one handle panel in the at least one top panel and at least one handle relief flap in the closed end of the carton, wherein the at least one handle relief flap is defined by at least one line of weakening in the top end flap, the at least one line of weakening comprises a first cut, a second cut, and a third cut, the first cut and the second cut extending from the fold line and the third cut is generally collinear with the fold line, the handle is for being activated by lifting at least the at least one handle panel, and the at least one handle relief flap is for being located between respective adjacent containers of the plurality of containers upon activation of the handle.

10. A carton for containing a plurality of articles, the carton comprising:

a plurality of panels that extends at least partially around an interior of the carton, the plurality of panels comprising at least one top panel and at least one side panel foldably connected to the at least one top panel;

at least one end flap respectively foldably connected to a respective panel of the plurality of panels, the at least one end flap at least partially forming a closed end of the carton, wherein the at least one end flap comprises a top end flap foldably connected to the at least one top panel; and a handle comprising at least one handle panel in the at least one top panel, a central handle flap in the top end flap, and at least one handle relief flap in the closed end of the carton, wherein the central handle flap is adjacent the at least one handle relief flap in the closed end, the at least one handle relief flap is defined by at least one line of weakening in the top end flap, the handle is for being activated by lifting at least the at least one handle panel, and the at least one handle relief flap is for being located between respective adjacent containers of the plurality of containers upon activation of the handle;

wherein the at least one handle relief flap comprises a first handle relief flap and a second handle relief flap in the top end flap, the first handle relief flap and the second handle relief flap are located in the closed end and aligned with gaps between respective adjacent articles of the plurality of articles to allow the first handle relief flap and the second handle relief flap to flex inwardly toward the interior of the carton upon activation of the handle.

11. A blank for forming a carton for containing a plurality of containers, the blank comprising:

a plurality of panels comprising at least one top panel and at least one side panel foldably connected to the at least one top panel;

at least one end flap respectively foldably connected to a respective panel of the plurality of panels, the at least one end flap at least partially forming a closed end of a carton formed from the blank, wherein the at least one end flap comprises a top end flap foldably connected to the at least one top panel; and handle features for forming a handle in the carton formed from the blank, the handle features comprising at least one handle panel in the at least one top panel, a central handle flap in the top end flap, and at least one handle relief flap in the closed end of the carton formed from the blank, wherein the central handle flap is adjacent the at least one handle relief flap, the at least one handle relief flap is defined by at least one line of weakening in the top end flap, the handle is for being activated by lifting at least the at least one handle panel when the carton is formed from the blank, and the at least one handle relief flap is for being located between respective adjacent containers of the plurality of containers upon activation of the handle;

wherein the at least one handle panel comprises a first handle panel in the first top panel for grasping and carrying the carton formed from the blank, the first handle panel is generally aligned with the central handle flap, and the central handle flap is generally aligned with a container adjacent the closed end of the carton formed from the blank so that the central handle flap remains continuous with the closed end of the carton formed from the blank upon activation of the handle.

12. The blank of claim 11, wherein the at least one top panel comprises a first top panel and a second top panel, and the at least one side panel comprises a first side panel and a second side panel, the first top panel is foldably connected to the second side panel and the second top panel is foldably connected to the first side panel, the at least one handle panel further comprises a second handle panel formed in the second top panel, the second handle panel comprises a central portion and an end portion that is wider than the central portion.

13. The blank of claim 12, wherein the top end flap is a first top end flap foldably connected to the first top panel, and the at least one end flap comprises a second top end flap foldably connected to the second top panel, the end portion is at least partially defined by a line of weakening that extends into the second top end flap.

14. The blank of claim 13, wherein the end portion comprises an opening in at least a portion of the second top end flap.

15. The blank of claim 14, wherein the first handle panel and the second handle panel are in at least partially face-to-face contact when the carton is formed from the blank, the opening is aligned with the central handle flap when the carton is formed from the blank, the at least one handle relief flap comprises a first handle relief flap and a second handle relief flap in the top end flap, and the end portion at least partially overlaps the first handle relief flap and the second handle relief flap when the blank is formed into the carton.

16. The blank of claim 12, wherein the at least one handle panel further comprises a third handle panel foldably connected to the second handle panel.

17. The blank of claim 16, wherein the second handle panel and the third handle panel cooperate with the first handle panel to form the handle when the carton is formed from the blank.

18. The blank of claim 12, wherein the handle features further comprise at least one handle flap foldably connected to the first handle panel at a respective lateral fold line and the first top panel comprises at least one arcuate opening respectively adjacent to the at least one handle flap.

19. A blank for forming a carton for containing a plurality of containers, the blank comprising:

a plurality of panels comprising at least one top panel and at least one side panel foldably connected to the at least one top panel;

at least one end flap respectively foldably connected to a respective panel of the plurality of panels, the at least one end flap at least partially forming a closed end of a carton formed from the blank, wherein the at least one end flap comprises a top end flap foldably connected to the at least one top panel and the top end flap is foldably connected to the at least one top panel at a fold line; and handle features for forming a handle in the carton formed from the blank, the handle features comprising at least one handle panel in the at least one top panel and at least one handle relief flap in the closed end of the carton formed from the blank, the at least one handle relief flap is defined by at least one line of weakening in the top end flap, the at least one line of weakening comprises a first cut, a second cut, and a third cut, the first cut and the second cut extending from the fold line and the third cut is generally collinear with the fold line, the handle is for being activated by lifting at least the at least one handle panel when the carton is formed from the blank, and the at least one handle relief flap is for being located between respective adjacent containers of the plurality of containers upon activation of the handle.

20. A blank for forming a carton for containing a plurality of containers, the blank comprising:

a plurality of panels comprising at least one top panel and at least one side panel foldably connected to the at least one top panel;

at least one end flap respectively foldably connected to a respective panel of the plurality of panels, the at least one end flap at least partially forming a closed end of a carton formed from the blank, wherein the at least one end flap comprises a top end flap foldably connected to the at least one top panel; and handle features for forming a handle in the carton formed from the blank, the handle features comprising at least one handle panel in the at least one top panel, a central handle flap in the top end flap, and at least one handle relief flap in the closed end of the carton formed from the blank, wherein the central handle flap is adjacent the at least one handle relief flap, the at least one handle relief flap is defined by at least one line of weakening in the top end flap, the handle is for being activated by lifting at least the at least one handle panel when the carton is formed from the blank, and the at least one handle relief flap is for being located between respective adjacent containers of the plurality of containers upon activation of the handle;

wherein the at least one handle relief flap comprises a first handle relief flap and a second handle relief flap in the top end flap, the first handle relief flap and the second handle relief flap are located in the closed end and aligned with gaps between respective adjacent articles of the plurality of articles to allow the first handle relief flap and the second handle relief flap to flex inwardly toward the interior of the carton formed from the blank upon activation of the handle.

21. A method of forming a carton for containing a plurality of containers, the method comprising:

obtaining a blank, the blank comprising a plurality of panels comprising at least one top panel, at least one side panel foldably connected to the at least one top panel, at least one end flap respectively foldably connected to a respective panel of the plurality of panels, and handle features comprising at least one handle panel in the at least one top panel, a central handle flap in the top end flap, and at least one handle relief flap in the at least one end flap, wherein the at least one end flap comprises a top end flap foldably connected to the at least one top panel, the central handle flap is adjacent the at least one handle relief flap in the closed end, the at least one handle relief flap is defined by at least one line of weakening in the top end flap, the at least one handle panel comprises a first handle panel in the first top panel for grasping and carrying the carton, the first handle panel is generally aligned with the central handle flap;

forming an interior of the carton by positioning the plurality of panels;

forming an at least partially closed end of the carton by positioning the at least one end flap; and forming a handle of the carton by positioning the handle features, wherein the handle is for being activated by lifting at least the at least one handle panel, the at least one handle relief flap is positioned to be located between respective adjacent containers of the plurality of containers upon activation of the handle, and the central handle flap is generally aligned with a container adjacent the closed end of the carton so that the central handle flap remains continuous with the closed end of the carton upon activation of the handle.

22. The method of claim 21, wherein the at least one top panel comprises a first top panel and a second top panel, and the at least one side panel comprises a first side panel and a second side panel, the first top panel is foldably connected to the second side panel and the second top panel is foldably connected to the first side panel, the at least one handle panel further comprises a second handle panel formed in the second top panel, the second handle panel comprises a central portion and an end portion that is wider than the central portion.

23. The method of claim 22, wherein the top end flap is a first top end flap foldably connected to the first top panel, and the at least one end flap comprises a second top end flap foldably connected to the second top panel, the end portion is at least partially defined by a line of weakening that extends into the second top end flap.

24. The method of claim 23, wherein the end portion comprises an opening in at least a portion of the second top end flap.

25. The method of claim 24, wherein the at least one handle relief flap comprises a first handle relief flap and a second handle relief flap in the top end flap, and the forming the handle comprises positioning the first handle panel and the second handle panel in at least partial face-to-face contact, aligning the opening with the central handle flap, and positioning the end portion and the first handle relief flap and the second handle relief flap in at least partially overlapping arrangement.

26. The method of claim 22, wherein the at least one handle panel further comprises a third handle panel foldably connected to the second handle panel.

27. The method of claim 26, wherein the second handle panel and the third handle panel cooperate with the first handle panel to form the handle.

28. The method of claim 22, wherein the handle features further comprise at least one handle flap foldably connected to the first handle panel at a respective lateral fold line and the first top panel comprises at least one arcuate opening respectively adjacent to the at least one handle flap.

29. A method of forming a carton for containing a plurality of containers, the method comprising:

obtaining a blank, the blank comprising a plurality of panels comprising at least one top panel, at least one side panel foldably connected to the at least one top panel, at least one end flap respectively foldably connected to a respective panel of the plurality of panels, and handle features comprising at least one handle panel in the at least one top panel and at least one handle relief flap in the at least one end flap, wherein the at least one end flap comprises a top end flap foldably connected to the at least one top panel at a fold line, the at least one handle relief flap is defined by at least one line of weakening in the top end flap, and the at least one line of weakening comprises a first cut, a second cut, and a third cut, the first cut and the second cut extending from the fold line and the third cut is generally collinear with the fold line;

forming an interior of the carton by positioning the plurality of panels;

forming an at least partially closed end of the carton by positioning the at least one end flap; and forming a handle of the carton by positioning the handle features, wherein the handle is for being activated by lifting at least the at least one handle panel, and the at least one handle relief flap is positioned to be located between respective adjacent containers of the plurality of containers upon activation of the handle.

30. A method of forming a carton for containing a plurality of containers, the method comprising:

obtaining a blank, the blank comprising a plurality of panels comprising at least one top panel, at least one side panel foldably connected to the at least one top panel, at least one end flap respectively foldably connected to a respective panel of the plurality of panels, and handle features comprising at least one handle panel in the at least one top panel, a central handle flap in the top end flap, and at least one handle relief flap in the at least one end flap, wherein the at least one end flap comprises a top end flap foldably connected to the at least one top panel, the central handle flap is adjacent the at least one handle relief flap in the closed end, the at least one handle relief flap is defined by at least one line of weakening in the top end flap, and the at least one handle relief flap comprises a first handle relief flap and a second handle relief flap in the top end flap;

forming an interior of the carton by positioning the plurality of panels;

forming an at least partially closed end of the carton by positioning the at least one end flap; and forming a handle of the carton by positioning the handle features, wherein the handle is for being activated by lifting at least the at least one handle panel, and the at least one handle relief flap is positioned to be located between respective adjacent containers of the plurality of containers upon activation of the handle, and the forming the handle comprises aligning the first handle relief flap and the second handle relief flap with gaps between respective adjacent articles of the plurality of articles to allow the first handle relief flap and the second handle relief flap to flex inwardly toward the interior of the carton upon activation of the handle.

* * * * *